US007980240B2

(12) United States Patent
Robson

(10) Patent No.: US 7,980,240 B2
(45) Date of Patent: Jul. 19, 2011

(54) BREAKING MACHINE

(75) Inventor: Angus Peter Robson, Matamata (NZ)

(73) Assignee: Terminator IP SA, Luxembourg (LU)

( * ) Notice: Subject to any disclaimer, the term of this patent is extended or adjusted under 35 U.S.C. 154(b) by 680 days.

(21) Appl. No.: 11/914,544

(22) PCT Filed: May 16, 2006

(86) PCT No.: PCT/NZ2006/000117

§ 371 (c)(1),
(2), (4) Date: Jul. 7, 2008

(87) PCT Pub. No.: WO2006/123950

PCT Pub. Date: Nov. 23, 2006

(65) Prior Publication Data

US 2009/0101377 A1 Apr. 23, 2009

(30) Foreign Application Priority Data

May 16, 2005 (NZ) ..... 540097
Nov. 22, 2005 (NZ) ..... 543739

(51) Int. Cl.
*B28D 1/32* (2006.01)

(52) U.S. Cl. ..... 125/23.01; 125/40; 125/41; 173/90; 173/129

(58) Field of Classification Search ..... 125/23.01, 125/40, 41; 173/39, 90, 128, 129
See application file for complete search history.

(56) References Cited

U.S. PATENT DOCUMENTS

| | | | | |
|---|---|---|---|---|
| 6,857,482 | B2 * | 2/2005 | Comarmond | 173/206 |
| 2001/0043007 | A1 * | 11/2001 | Jang | 299/69 |
| 2005/0167131 | A1 * | 8/2005 | Hurskainen et al. | 173/206 |
| 2006/0048957 | A1 * | 3/2006 | Oksman | 173/77 |
| 2007/0193420 | A1 * | 8/2007 | Van Baal | 81/463 |
| 2009/0101377 | A1 * | 4/2009 | Robson | 173/89 |
| 2010/0126746 | A1 * | 5/2010 | Robson | 173/211 |

* cited by examiner

*Primary Examiner* — Eileen P. Morgan
(74) *Attorney, Agent, or Firm* — Stephen M. De Klerk; SNR Denton US LLP

(57) ABSTRACT

A breaking apparatus (1) including a movable mass (3) for impacting on a striker pin (4), a housing (2) and a striker pin (4) configured to partially protrude through the housing (2), the apparatus (1) characterized in that the striker pin (4) is configured to be beatable in a plurality of retaining locations relative to the housing (2).

9 Claims, 5 Drawing Sheets

BREAKING MACHINE

CROSS-REFERENCE TO OTHER APPLICATIONS

This is a National Phase of International Application No. PCT/NZ2006/000117 filed on May 16, 2006, which claims priority from New Zealand Patent Application No. 540097 filed on May 16, 2005 and New Zealand Patent Application No. 543739 filed on Nov. 22, 2005.

TECHNICAL FIELD

This invention relates to improved breaking machines.

Reference throughout the specification should be made to the invention as being in relation to breaking machines that are gravity drop hammers although this should not be seen as limiting.

BACKGROUND ART

Gravity drop hammers are primarily designed for surface breaking of exposed rock.

These machines generally consist of a striker pin which extends outside of a nose cone which is positioned at the end of a housing that contains a heavy movable mass known as a monkey.

In a typical mode of operation, the weight of the machine is used to press the striker pin onto the surface to be broken. The correct positioning of the pin is known as priming which not only ensures the pin is at the right place, but is also in the striking position.

The movable mass is then lifted and allowed to drop onto the pin which then impacts the rock and the sequence is repeated until the rock breaks.

The striker pin wears away during use and is the main consumable tool of the breaking apparatus. Ensuring the pin is replaced at the optimal time is a key factor in cost-effective operation of the breaker. However, due to the cost and inconvenience of replacing the striker pin, there is a tendency amongst operators to continue to wear down the pin beyond the optimal replacement point.

It is an important operational requirement that the operator is able to sight the end of the pin. Reducing visibility of the pin tip reduces the operator's ability to locate the point correctly on seams or weak points. If the pin is not correctly primed onto rock, this can result in 'dry hitting', where only the nose block rather than the pin is resting on the rock. When a dry hit occurs, all the drop hammer energy must be absorbed into the hammer's buffer system and housing rather than the rock. Excessive dry hitting can cause structural damage and high wear and tear on parts increasing costs further. Moreover, a dry hit clearly does not break any rock, causing a consequential reduction in productivity. Typical drop hammers displaying such drawbacks are described in Australian Patent No. 585274.

The present invention throughout the specification will be discussed in relation to rock breaking apparatus invented by the applicant which is sold under the trade mark Terminator™. This will be understood to be exemplary only and the invention is not limited to use with same. The Terminator™ breaker represents an improvement (described in PCT Application No. PCT/NZ93/00074) over the hammer described in Australian Patent No. 585274.

The Terminator™ breaker is a gravity drop hammer that is configured for excavator carriers over 20 tonnes. Striker pins for this type of machine usually last around 500 hours and should be replaced after 25% of the pin is worn away. Replacing these pins costs around NZ$2,000 which represents 60% of the breaker operating costs. The Terminator™ breaker has design features (described in PCT Application No. PCT/NZ93/00074) to accommodate small numbers of dry hits and partial dry hits. However, it is still possible that excessive dry hitting can cause structural damage as described above in relation to other machines.

Even if the breaker is able to withstand dry hitting without sustaining damage, the adverse effect on productivity is still significant. As an illustration, the Terminator™ breaker typically produces 150 tons of rock per hour and the value of this material is around NZ$3 per tonne ($450 per hour). A 50% process loss or 75 tonnes/hour (which can be typical with dry hits) equates to NZ$225 per hour. The cost to run an excavator and Terminator™ breaker is around NZ$200 an hour irrespective of output, made up of labour, excavator costs, Terminator™ costs, fuel and so forth. This means that the operating loss is in the order of an additional NZ$100 plus the excess wear and tear caused by the dry hitting.

Therefore using the above figures, using an overly short striker pin can cost more than NZ$300 per hour. While it might seem obvious for the operator to change the pin earlier there are a number of factors dissuading them from doing so.

Breakers such as the Terminator™ breaker generally operate remotely from other plant and workshops and consequentially there is little equipment assistance to perform servicing work. Furthermore, it is impractical to return the breaker to the workshop for surfacing as it is semi-permanently attached to a digger. Detaching and subsequent re-attaching of the breaker and transportation to and from the workshop would typically require several hours.

A superficially simple solution is to increase the length of the pin extending out from the nose of the breaker so that it takes longer to wear down to an unusable size. However, such over-length pins are likely to snap during operation and thus this option is not preferred. The applicant has also devised a newer version of the Terminator™ described in the co-pending application NZ Pat App no. 543739 (referred to herein as Terminator II™) which, in addition to performing surface breaking tasks of conventional drop hammers, can also perform levering and high intensity raking. In contrast, conventional hammer manufacturers recommend against high intensity raking and levering due to the risk of shearing the striker pin.

Raking involves using the excavator to pull surface rock along the ground using the side of the pin. The rock can be loose above the ground surface or be friable enough to be drawn towards the excavator by pressing the point of the pin into the in-situ rock and dragging it across. Although the tractive resistance of the excavator does limit the maximum side forces applicable to the striker pin to a degree, the inertia of the two large pieces of equipment is high.

Levering is in particular a very useful action of the Terminator II™ rock breaker and involves driving the point of the striker pin into non-friable in-situ rock creating a crack. Once the crack is established, the operator can rotate the Terminator II™ at one end of the boom attached to the excavator to lever the rocks from the ground. Side forces are limited by inertia and the excavator hydraulics capabilities.

The operator can also use a hammer blow while levering to increase break out force. This is not feasible while raking so generally levering loads are a lot higher than raking loads but allow rock extraction in harder rocky deposits.

To perform these functions it is essential that a minimum pin length is maintained as raking is less effective with a short pin and levering is not possible at all.

It is thus desirable to provide a striker pin capable of an increased effective working lifespan, without breaking or requiring early replacement.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a breaking apparatus which includes a movable mass for impacting on a striker pin;

a housing, and a striker pin configured to partially protrude through the housing, said apparatus characterised in that the striker pin is configured to be locatable in a plurality of retaining locations each defining a fixed range of striker pin longitudinal travel allowable during use in impacting operations wherein the striker pin is attached to the breaker at a retaining location by a slide-able coupling configured to allow the striker pin said range of longitudinal travel during impacting operations, and also providing, with respect to said driven end, a distal and proximal travel stop for the striker pin.

As used herein, the term 'housing' is used to include, but is not restricted to, any portion of the breaker used to locate and secure the striker pin, including any external casing or protective cover, nose-block portion through which the striker pin protrudes, and/or any other fittings and mechanisms located internally or externally to said protective cover for operating and/or guiding said moveable mass to contact the striker pin, and the like.

The term 'striker pin' refers to any elements acting as a conduit to transfer the kinetic energy of the moving mass to the rock or work surface. Preferably, the striker pin comprises an elongate element with two opposed ends, one end (generally located internally in the housing) being the driving end which is driven by impulse provided by collisions from the moveable mass, the other end being an impact end (external to the housing) which is placed on the work surface to be impacted. The striker pin may be configured to be any suitable shape or size. In a preferred embodiment, the striker pin has a cross section corresponding to known striker pins, though with a greater longitudinal length. In one embodiment, the striker pin is held in each of said plurality of positions by the same mechanism commonly used to hold the pin in a single position on prior art breakers.

Though reference is made throughout the present specification to the breaking apparatus as being a rock breaking apparatus, it should be appreciated that the present invention is applicable to other breaking apparatus.

In preferred embodiments, after being raised, the movable mass (or 'monkey') is allowed to fall under gravity to provide impact energy to the driven end of the striker pin. However, it should be appreciated that the principles of the present invention could possibly apply to breaking apparatus having types of powered hammers, for example hydraulic hammers.

However with hydraulic hammers the piston arrangement is such that a multi-position striker pin configuration would be difficult to achieve due to the integration of the percussion mechanism with the driving end of the striker pin. However, the present invention can be used to significant effect on power-assisted gravity drop hammer breaking apparatus such as the applicant's Terminator™ breaker.

As used herein, the terms 'retaining location' refers to the location of a fixed range of striker pin longitudinal travel allowable during use in impacting operations. The striker pin must be configured with some form of moveable or slideable attachment to the breaker housing to allow the impulse of the impact by the movable mass to be transmitted through the striker pin to the work surface without transmitting any appreciable force to the breaker housing and mounting. Thus, the striker pin is attached to the breaker at a retaining location by a slideable coupling allowing the striker pin a degree of longitudinal travel during impacting operations, and also providing, with respect to said driven end, a distal and preferably proximal travel limit for the striker pin.

Typically, in prior art breakers the slideable coupling is formed from at least one releasable retaining pin which can be inserted into either the striker pin or the walls of the housing adjacent the striker pin (i.e. the nose block) such that the pin or pins partially protrudes into a corresponding indent or recess in the striker pin or housing walls. The indent typically extends parallel to the striker pin longitudinal axis for a distance defining the allowable striker pin travel during impact operations before the retaining pin engages with the longitudinal ends of the indent. Thus, together with the length of the striker pin, the position and length of the indent and the position of the releasable retaining pin(s) defines the maximum and minimum extent to which the striker pin protrudes from the housing. The proximal indent stop is also required to prevent the striker pin from falling out of the breaker, while the distal stop prevent the striker pin being pushed completely inside the housing when operator position the breaker in the priming position.

The retaining pin(s) are removed to allow the striker pin to removed and re-inserted into the breaker housing. After the striker pin is inserted into the housing, the retaining pins(s) are inserted, fitting at least partially into an indent on the side of the striker pin. The indent allows movement of the striker pin along its longitudinal axis between the ends of the indent. When the striker pin is in a primed position, i.e., ready to receive and transmit the impact from the movable mass to the work surface, the retaining pin is at the end of the indent closest to the work surface. This is caused as a consequence of positioning the breaker tip as close to the working surface as the striker tip will allow, thereby priming the striker pin by forcing it into the housing until being restrained by the retaining pin(s) engaging with the lowermost upper extent of the indent furthest from the work surface.

When the movable mass is dropped onto the striker pin, the striker pin is forced into the work surface until it is prevented from any further movement by the retaining pin meeting the other end of the indent closest to the movable mass.

In further embodiments of the present invention the slideable coupling is configured such that at least two indents or sets of indents positioned along the striker pin enable the striker pin to be held by the retaining pin(s) at two or more retaining locations.

In alternative embodiments the slideable coupling includes two or more attachment locations for said retaining pins. Thus, one or more longitudinally extending indent(s) on the striker pin can be moved to selectively align with the different locations of the retaining pin(s).

It will be readily appreciated that the striker pin slideable coupling need not necessarily be comprised of releasable pin(s) and associated indent(s). Any suitable configuration of slideable coupling may be used which is capable of slideably retaining the striker pin travel within defined limits, including multiple retaining pins, either parallel or other orientations; bayonet/twist-type attachments; threads; slotted threads; clips; wedges and so forth used in conjunction with one or more recesses, indents or the like located along a longitudinal edge of the striker pin, or housing portion (typically the nose block) adjacent the striker pin or both.

Once the pin has worn down to a predetermined length, the retaining pins can be removed from the first retaining location indent. The striker pin can then be moved downwards relative to the housing so a second retaining location indent is aligned substantially with the retaining pins. This can be readily achieved if the striker pin has sufficient length to extend from the nose cone in the new position after initial erosion of the pin.

In alternative embodiments of the present invention, adjacent retaining location indents positioned on the striker pin are not longitudinally aligned. Thus by way of example, the first retaining location indent may be offset approximately 90° with regard to the second retaining location indent requiring the pin to be dropped and also turned through 90° to align with the retaining pins in the second retaining location. However, this configuration enables the portion of the pin adjacent the first indent of the first retaining location to act as a bearing surface flush against the surface of the adjacent housing nose cone during levering and raking operations when the pin is in a second retaining location.

Thus, according to a further aspect, the present invention includes a method of increasing the workable lifespan of a striker pin in a breaking apparatus as aforementioned, said method including the steps:

- determining the striker pin has been worn to a predetermined point;
- removing one or more retaining pins attaching the striker pin to the breaking apparatus at a first retaining location;
- increasing the protrusion of the striker pin from the breaking apparatus housing until the retaining pin(s) may be re-attached to the breaking apparatus at a second retaining location.

Preferably, the retaining pins(s) are attached to the breaking apparatus to at least partially protrude into a longitudinal indent on the side of the striker pin or housing adjacent the striker pin.

According to one embodiment, where the indents at said first and second retaining locations are longitudinally offset from each other, that in addition to longitudinal movement, the method further includes rotating the striker pin to align the indent and retaining pin during the step of moving the striker pin between said first and second retaining locations.

It should be appreciated that the present invention can include more than two retaining locations for the striker pin. It will also be appreciated however that if the degree of striker pin protrusion is kept constant, a large increase in the total length of the pin appreciably moves the location of the driven end within the housing thus reducing the available travel of the movable mass before impacting the driven end. The reduced movable mass travel would generate a reduced impact energy transfer to the work surface.

The present invention has a number of advantages over the prior art illustrated in the following discussion.

Table 1 illustrates a comparison of prior-art machines of equivalent class vs. the applicant's Terminator II™ breaker utilising the present invention in the 40 tonne excavator class for typical side loads allowable without damage.

TABLE 1

| | Hydraulic Hammer | Conventional Gravity Drop Hammer | Terminator II |
|---|---|---|---|
| Raking side load | 10 tonne | 20 tonne | 40 tonne |
| Levering breakout torque | 10 tonne · Metres * | N/A (cannot lever) | 100 tonne · Metres |

(* Levering is not allowed, but the pin will not break up to this load. One tonne metre ≈ 9800 Newton metres)

The optimum striker pin length for levering is greater than for breaking, so a standard drop hammer pin can only be worn around 15% before it will no longer lever effectively. Replacing the striker pin incurs a consumable cost of about NZ$28 per hour. Doubling the wear lifespan to 30% of the striker pin length would achieve a cost saving of at least NZ$12 per hour.

Table 2 shows hourly parts and maintenance cost for the a breaker (e.g. the applicant's Terminator II™ breaker) utilising the present invention, broken down according to the cost of the striker pin and other maintenance items. It will be noted that wear and tear rises when an overly short striker pin is used. (costs are provided in New Zealand dollar currency).

TABLE 2

| | Maintenance cost | | | | | |
|---|---|---|---|---|---|---|
| | Typical Prior Art Gravity Drop Hammer | | | Present invention breaker (Terminator II ™) | | |
| | Std pin | Other | Total | 2 life pin | Other | Total |
| Breaking | $12 + | $8 = | $20 | $6 + | $6 = | $12 |
| Levering | $20 + | $8 = | $28 | $10 + | $6 = | $16 |
| Average | | | $24 | | | $14 |

A prior art breaker (such as the applicant's Terminator™) run by a skilled operator following good practice typically returns a net profit of 15% of turnover per job, e.g. a NZ$15 per hour profit for a NZ$100 per hour hire charge for the breaker. It can be seen from Table 2 that the lengthened striker pin reduces operator cost by NZ$10 which increases the average net profit by at least 60%, even without accounting for any production losses caused by using an overly short striker pin.

A further advantage of the present invention is that if very deep penetration is required (typically for brief periods only) e.g. for breaking very thick concrete, extra extension can be achieved by increasing the protrusion by placing a new uneroded striker pin into the secondary 'worn' retaining location. This capability saves on making and stocking extra-length pins for the infrequent occasions required. As discussed above, only minimal raking and levering actions may be performed in such circumstances to avoid the risk of shearing the striker pin.

The present invention thus provides an expedient means of increasing the commercial and operational effectiveness of breaking devices by virtue of a readily manufactured improvement to existing striker pins/breakers.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1B:
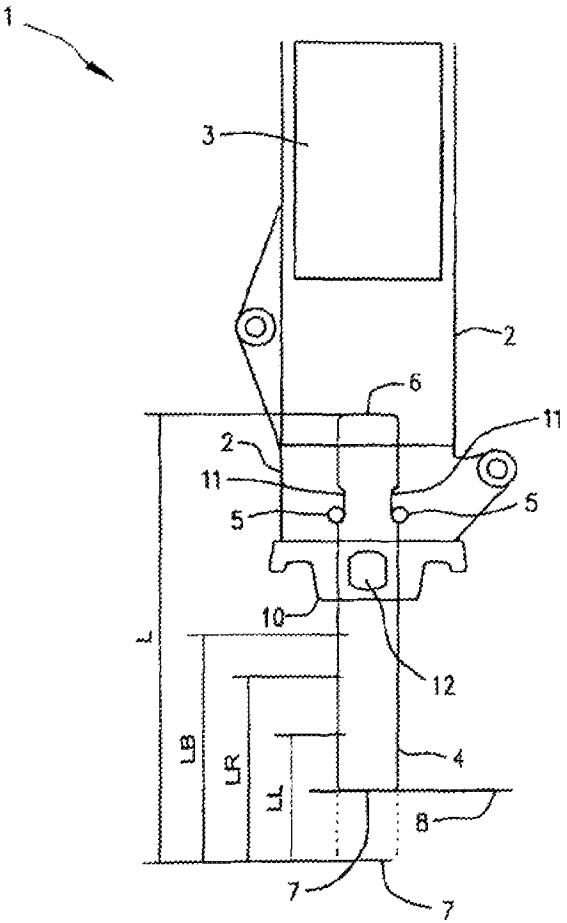
FIG. 1*a-d* show a range of prior art striker pins attached to different breakers.

The present invention as shown in the drawings consists, in one aspect, of an improved striker pin, and in a broader sense, a breaking apparatus or 'breaker' (1) including said improved striker pin. A range of prior art breakers and associated striker configurations are depicted in FIG. 1 *a-d*, including the applicant's Terminator II™ breaker (in FIGS. 1*a-b*), a prior art breaker (shown in FIG. 1*c*) and a breaker unit attached to a hydraulic breaker (as shown in FIG. 1*c*).

Breakers or hammers (1) typically consist of some form of housing (2), which includes a mounting to attach the breaker to a carrier, or excavator (not shown) and a guide for reciprocating movement of a movable mass (3) (either free falling or power assisted) which is used to impact a striker pin (4) located in, and protruding through, the housing (2) typically via a portion of the housing (2) known as the nose block (10).

The striker pin (4) is an elongate solid rod, generally cylindrical with two opposing ends, i.e. a driving end (6) and an impact end (7). The driving end (6) is located within the housing (2) and is impacted by the movable mass (3) during breaking operations to transmit the impact energy through the striker pin (4) to the impact end (7) placed in contact with the work surface (8)

Over time, operational use of the breaker (1) erodes the impact end (7) of the striker pin (4) beyond the point of effective usage and therefore the pin (4) must be replaced. In prior art breakers (1) this requires complete removal from the housing (2) and replacement of a new striker pin (4). It is thus desirable, both economically and for the convenience of the operator, to be able to extend the usable lifespan of the striker pin (4). This is achieved in the present invention by providing the breaker with two or more retaining locations for a striker pin (4) of extend length.

Prior art hydraulic percussion hammers (1) such as shown in FIG. 1 *d*) have a striker pin (4) which is held in position by retaining pins (5). However, the driving end (6) of the striker pin (4) is integrated with the percussion mechanism (9) within the hydraulic hammer (1). This integration makes it impracticable to use a plurality of retaining locations for the striker pin (4) due to insufficient room to accommodate a percussion mechanism above the driving end (6) capable of operating in two or more positions.

Prior art gravity drop hammer breakers (1) such as shown in FIG. 1*c*) also utilise a slideable coupling in the form of striker pin (4) positioned in the housing (2) to pass through a nose block (10) and held in a single retaining position by retaining pin (5) located within an indent (11). A retaining location allows a degree of longitudinal travel for the striker pin (4) between two end stops of a longitudinally extending indent (11). It will be readily appreciated by one skilled in the art that the indent may be formed in one of either the surface of the striker pin (4) and the retaining pin inserted into adjacent (typically cylindrical) guide walls of the nose block (10) locating the striker pin (4) such that the retaining pin at least partially to protrudes into the indent (11) or vice versa.

Figure 1A:
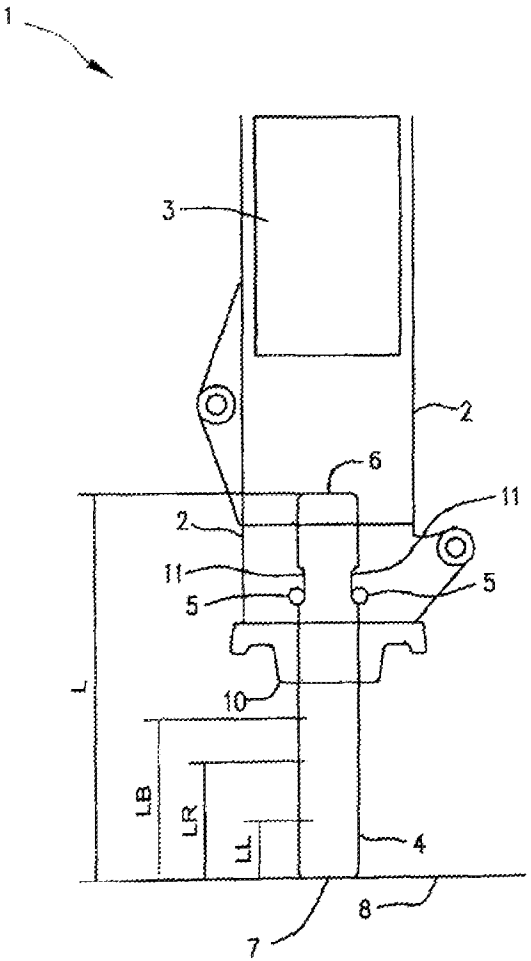
Figure 1D:
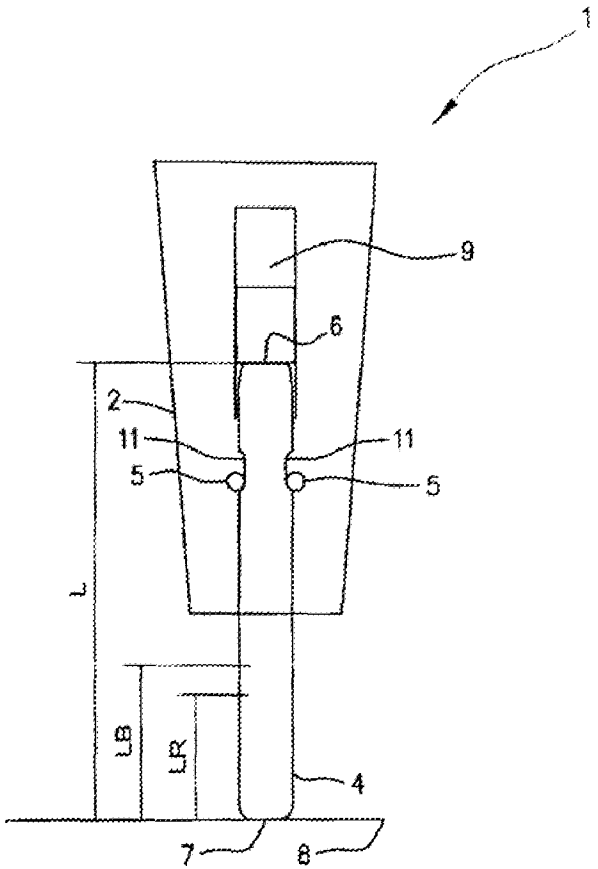
Figure 1C:
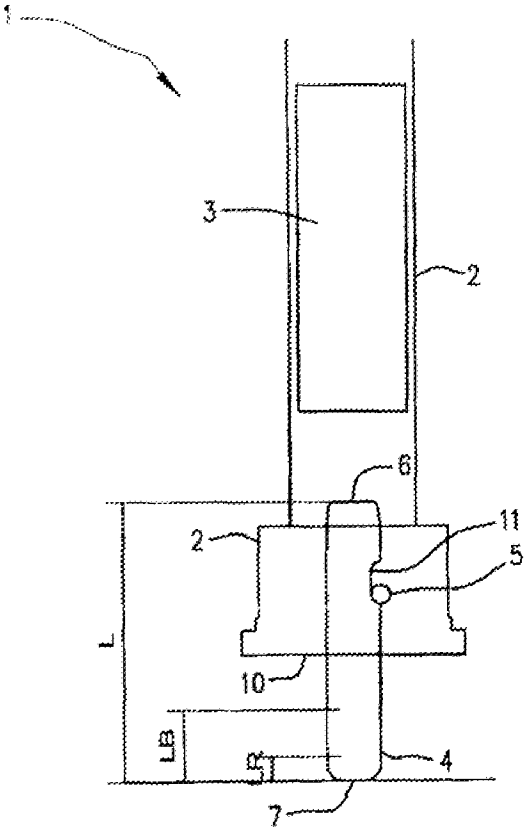
Figure 2:
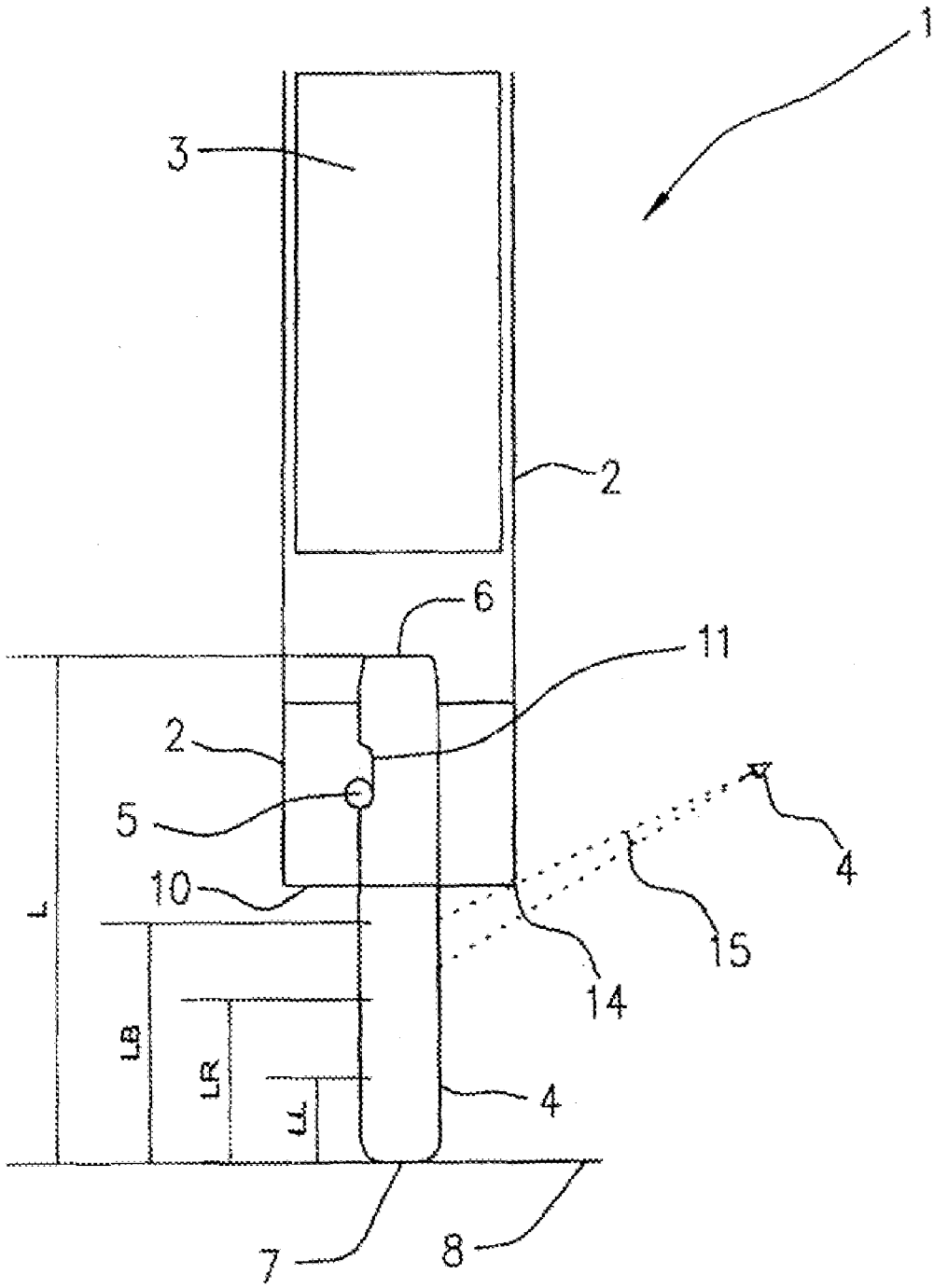
FIG. 2 show an enlarged schematic side elevation of the prior art striker pin and breaker shown in FIG. 1*c*)

The Terminator II™ breakers (1) illustrated in FIGS. 1*a*) and 1*b*) are shown with a striker pin (4) with a single and dual retaining position respectively. It will be readily discerned that the striker pin (4) in FIG. 1*b*) is significantly longer than that in FIG. 1*a*), while the movable mass (3) in FIG. 1*b*) is positioned higher above the driven end (6) of the striker pin (4) than the corresponding movable mass mounting in FIG. 1*a*). The two retaining locations provided by two sets of indents (11, 12) are longitudinally spaced apart from each other and offset radially by approximately 90° from each other FIG. 2 depicts a schematic enlargement of the embodiment shown in FIG. 1*c*) showing more clearly how the sight line of the operator (13) can be compromised as the pin (4) is eroded away through use. As the impact end (7) is worn closer to the housing (2) the length of the pin (4) projecting past housing nose block corner (14) gradually reduces, consequentially reducing the angle (15) subtended at the operators eye by the visible length of the striker pin (4). Consequentially, providing an accurate control over positioning of the striker pin (4) and in particular the impact end (7) becomes problematic.

Figure 3B:
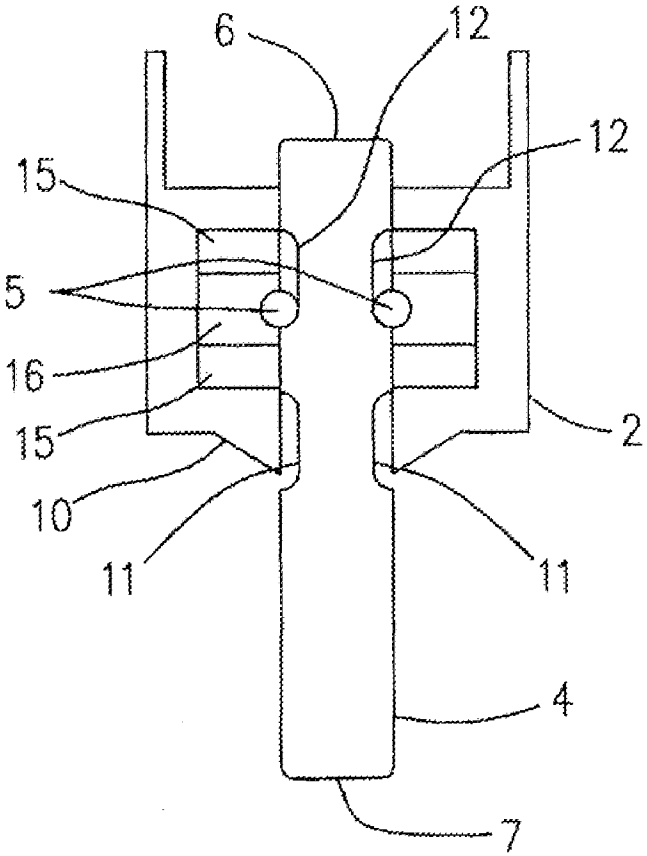
FIG. 3*a-b* show an enlarged side elevation section of the present invention shown with the striker pin in two distinct retaining locations.
Figure 3A:
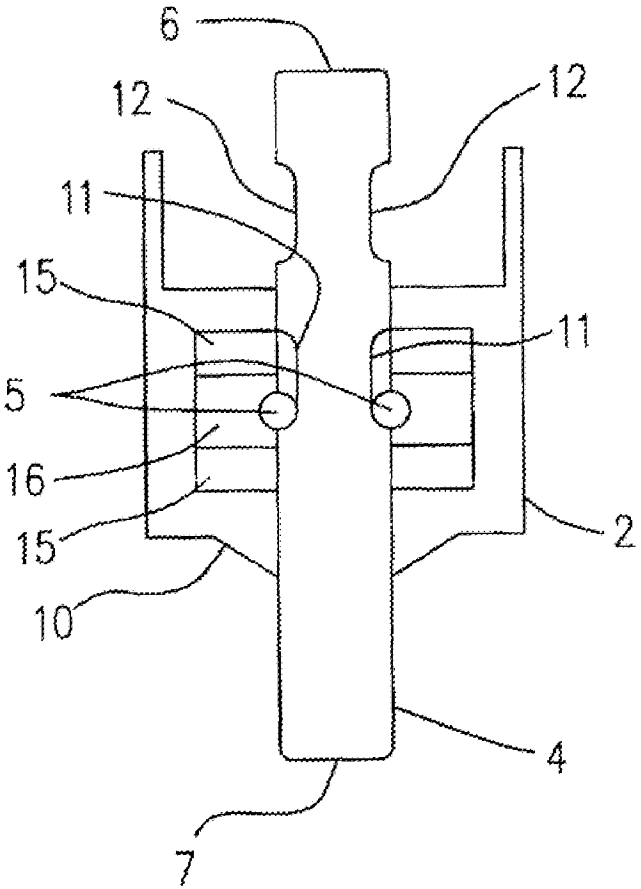

FIGS. 3*a* and 3*b* show an enlarged view of the nose block (10) portion of the housing (2) and striker pin (4) attachment thereto. The striker pin (4) is again attached to the nose block by a slideable coupling in the form of retaining pins (5) and indentations in the striker pins (4) to locate the striker pin (4) within a retaining location. FIGS. 3*a* and 3*b* both illustrate a striker pin embodiment with two sets of longitudinally-separated indentations (11, 12) where the two sets of recesses (11, 12) are located at separate radial orientation to each other preventing the recesses aligning longitudinally along the striker pin (4).

Table 3 illustrates the comparative lengths for each of the breakers shown in FIG. 1 and FIG. 2. The length ratios are as follows; L is the total pin length, LL stands for levering length, LA raking length and LB breaking length.

Thus the ratio LL/L is the percentage of original striker pin worn before levering is inefficient. LR/L is the percentage of original striker pin worn before raking is inefficient, and LB/L is the percentage of original striker pin worn before breaking is inefficient.

| | Breaker 1 (Hydraulic) | Breaker 2 (Old Terminator) | Breaker 3b (Terminator II with a single position pin) | Breaker 3a (Terminator II with double position pin) |
|---|---|---|---|---|
| $\frac{LL}{L}$ | N/A - pin will snap | N/A - pin to short | 15% | 28% |

-continued

| | Breaker 1 (Hydraulic) | Breaker 2 (Old Terminator) | Breaker 3b (Terminator II with a single position pin) | Breaker 3a (Terminator II with double position pin) |
|---|---|---|---|---|
| LR/L | 27% | 8% | 30% | 42% |
| LB/L | 33% | 25% | 41% | 50% |

FIG. 3 illustrates more closely the two-position arrangement of one embodiment of the Terminator II™ breaker.

In the embodiment shown in FIG. 3, the striker pin (4) has two set of indents (11) and (12). The striker pin (4) extends from a nose block (10) which includes buffers (15), a retaining plate (16) and retaining pins (5).

The retaining pins (5) are floating in between the buffers (15) attached to a retaining plate (16) rather than fixed into a solid steel block.

Initially the striker pin (4) will be held by retaining pins (5) around the first indent (11) as illustrated in FIG. 3*a*.

Once the striker pin (4) has worn down, the retaining pins (5) can be withdrawn allowing the second indent (12) of the striker pin (4) to be held by the retaining pins (5).

The striker pin (4) shown in FIGS. 3*a* and 3*b* is configured with two indents (11) and (12) which are substantially aligned longitudinally along the side of the striker pin (4).

Figure 4A:
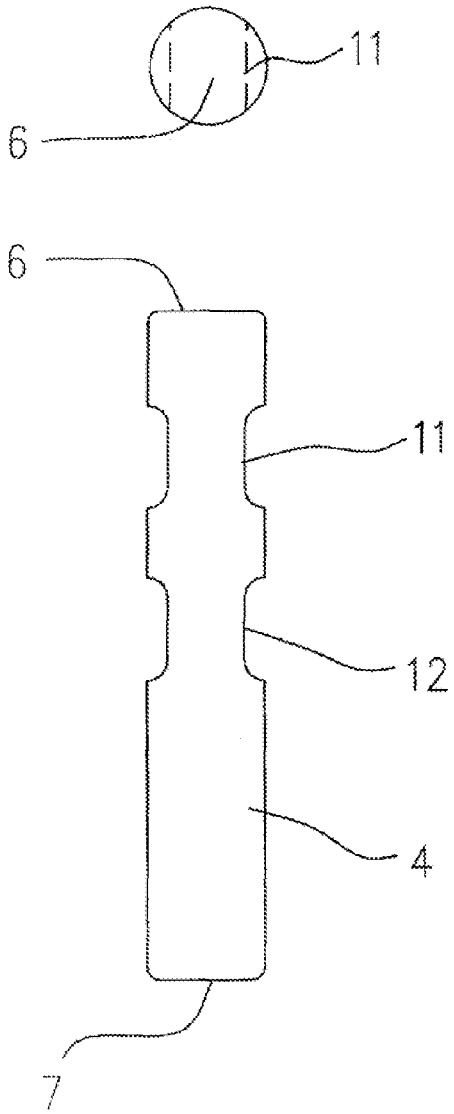
FIG. 4*a-b* shows a side elevation and plan views of the striker pin according to a further aspect of the present invention.
Figure 4B:
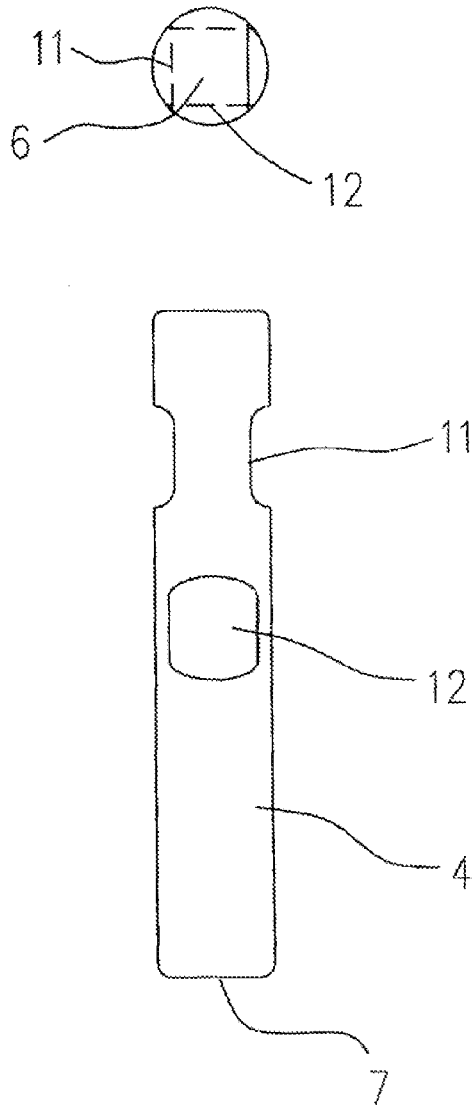

An alternative striker pin (4) embodiment is shown in FIG. 4. FIG. 4*a* shows the same striker pin (4) as shown in FIG. 3*a-b*, with two retaining location indents (11,12) longitudinally with each other, while FIG. 1*b* shows an alternative striker pin (4) embodiment with indents (11) and (12) longitudinal separated and positioned substantially at 90° with respect to each other. This latter embodiment provides a more robust striker pin (4) for use with the applicants Terminator II™ breaker during levering and raking actions (as described previously). If the striker pin (4) shown in FIG. 4*a*) was used in for such purposes with the striker pin (4) retained in the upper indents (12) (as also shown in FIG. 3*b*), there is reduced lateral support at the striker pin's (4) exit point from the nose block (10). Thus by using the striker pin (4) of FIG. 4*b*) with the lower indents (11) offset by 90° to the upper indents (12), a non-indented portion of the pin (4) provides a bearing surface flush against the nose block in the housing (2) when the pin (4) is located in its second indent (12).

Aspects of the present invention have been described by way of example only and it should be appreciated that modifications and additions may be made thereto without departing from the scope thereof.

What is claimed is:

1. A breaking apparatus including:

a movable mass for impacting on a striker pin;

a housing containing the mass and striker pin, and the striker pin configured to be axially aligned with the mass and partially protrude through the housing to engage a work surface to be impacted, said apparatus characterised in that the striker pin has at least two indents at different longitudinal locations and is configured to be locatable in a plurality of longitudinal retaining locations, each location defining a fixed range of striker pin longitudinal travel allowable during use in impacting operations wherein the striker pin is attached to the breaker housing at a retaining location by a retaining pin coupling with one of the indents configured to allow the striker pin said range of longitudinal travel during impacting operations, and also providing, with respect to said driven end, a distal and proximal travel stop for the striker pin.

2. A breaking apparatus as claimed in claim 1, wherein said striker pin is an elongate element with two opposed ends, one end being the driving end located internally in the housing and driven by impulse provided from collisions from the moveable mass, the other end being an impact end located externally to the housing for placement on the work surface to be impacted.

3. A breaking apparatus as claimed in claim 1, wherein said retaining pin is a releasable retaining pin capable of rigid attachment to one of either the striker pin or the walls of the housing adjacent the striker pin such that it partially protrudes into an indent.

4. A breaking apparatus as claimed in claim 3, wherein said indent extends parallel to the striker pin's longitudinal axis for a distance defining the allowable striker pin travel during impact operations before the retaining pin engages with said distal and proximal travel stops formed by the longitudinal ends of the indent.

5. A breaking apparatus as claimed in claim 3, including two or more attachment locations for said retaining pins.

6. A breaking apparatus as claimed in claim 1, wherein adjacent retaining location indents positioned on the striker pin are not longitudinally aligned.

7. A method of increasing the workable lifespan of a striker pin in a breaking apparatus as claimed in claim 1, said method including:

determining the striker pin has been worn to a predetermined point;

removing one or more retaining pins attaching the striker pin to the breaking apparatus housing at a first retaining location; and increasing the protrusion of the striker pin from the breaking apparatus housing until the retaining pin(s) may be re-attached to the breaking apparatus housing at a second retaining location.

8. The method as claimed in claim 7, wherein the retaining pin(s) are attached to the breaking apparatus housing to at least partially protrude into a longitudinal indent on the side of the striker pin or housing adjacent the striker pin.

9. The method as claimed in claim 8, wherein, the indents at said first and second retaining location are longitudinally offset from each other, such that in addition to longitudinal movement, the striker pin is also rotated to align the indent and retain pin during the step for moving the striker pin between said first and second retaining locations.

* * * * *